US008695709B2

(12) United States Patent
Zimmerman et al.

(10) Patent No.: US 8,695,709 B2
(45) Date of Patent: Apr. 15, 2014

(54) SELF-ORIENTING CROSSOVER TOOL

(75) Inventors: Patrick J. Zimmerman, Houston, TX (US); John Broussard, Kingwood, TX (US); Christopher Hall, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 236 days.

(21) Appl. No.: 12/862,833

(22) Filed: Aug. 25, 2010

(65) Prior Publication Data

US 2012/0048562 A1 Mar. 1, 2012

(51) Int. Cl.
*E21B 34/00* (2006.01)

(52) U.S. Cl.
USPC ..... 166/319; 166/278; 166/321; 166/330

(58) Field of Classification Search
USPC ..... 166/321, 278, 266, 317, 330, 319
See application file for complete search history.

(56) References Cited

U.S. PATENT DOCUMENTS

| | | | | |
|---|---|---|---|---|
| 3,993,130 | A | 11/1976 | Papp | |
| 4,044,832 | A | 8/1977 | Richard et al. | |
| 4,262,693 | A * | 4/1981 | Giebeler | 137/494 |
| 4,296,807 | A | 10/1981 | Hendrickson et al. | |
| 5,636,691 | A | 6/1997 | Hendrickson et al. | |
| 6,702,020 | B2 | 3/2004 | Zachman et al. | |
| 6,782,948 | B2 | 8/2004 | Echols et al. | |
| 6,978,840 | B2 | 12/2005 | Henderson | |
| 7,032,666 | B2 | 4/2006 | Corbett | |
| 7,096,946 | B2 | 8/2006 | Jasser et al. | |
| 7,128,151 | B2 | 10/2006 | Corbett | |
| 7,383,884 | B1 | 6/2008 | Turner et al. | |
| 7,762,324 | B2 | 7/2010 | Clem | |
| 2007/0017679 | A1 | 1/2007 | Wolf et al. | |
| 2009/0084553 | A1 | 4/2009 | Rytlewski et al. | |

OTHER PUBLICATIONS

Weatherford, "Model WFX Crossover Too," Brochure 4865.02, copyright 2007-2010.
Weatherford, "Model 4P Gravel-Pack System," Brochure 6540.00 copyright 2009.
Weatherford, "Model 4P Retrievable Seal-Bore Packer Gravel-Pack System," Brochure 1335.01, copyright 2005-2009.
Examiner's Requisition received for corresponding Canadian Patent Application No. 2,747,277, dated Dec. 28, 2012.
Examiner's first report received for corresponding Australian Patent Application No. 2011205112, dated Mar. 19, 2013.
Second Requisition in counterpart Canadian Appl. 2,747,277, dated Sep. 20, 2013.

* cited by examiner

*Primary Examiner* — Daniel P Stephenson
*Assistant Examiner* — Taras P Bemko
(74) *Attorney, Agent, or Firm* — Wong, Cabello, Lutsch, Rutherford & Brucculeri LLP

(57) ABSTRACT

A crossover tool has an internal sleeve rotatably positioned within an external sleeve, and each of the sleeves has ports alignable with ports on the other sleeve. After deploying the crossover tool downhole and diverting fluid flow below the tool, fluid flow communicated into the internal sleeve tends to rotate it relative to the external sleeve until the ports are substantially aligned so that wear to the components is substantially reduced. The ports themselves may facilitate the rotation and alignment. For example, ports on the internal sleeve may produce tangentially exiting fluid flow. Alternatively, an additional outlet may be defined in the internal sleeve and eccentrically located to its rotation axis. Furthermore, an internal sleeve or insert may partially block fluid flow through the ports to allow greater fluid flow through the additional outlet to enhance rotation of the internal sleeve.

38 Claims, 7 Drawing Sheets

SELF-ORIENTING CROSSOVER TOOL

BACKGROUND

During oilfield production, granular materials in slurry form can be pumped into a wellbore to improve the well's production. For example, the slurry can be part of a gravel pack operation and can have solid granular or pelletized materials (e.g., gravel). Operators pump the gravel slurry down the tubing string. Downhole, a cross-over tool with exit ports diverts the slurry from the tubing string to the wellbore annulus so the gravel can be placed where desired. Once packed, the gravel can strain produced fluid and prevent fine material from entering the production string. In another example, operators can pump high-pressure fracture fluid downhole during a fracturing operation to form fractures in the formation. This fracturing fluid typically contains a proppant to maintain the newly formed fractures open. Again, a crossover tool on the production string can be used in the fracturing operation to direct the slurry of proppant into the wellbore annulus so it can interact with the formation.

Flow of the slurry in these operations significantly wears the production assembly's components. For example, the slurry is viscous and can flow at a very high rate (e.g., above 10 bbls/min). As a result, the slurry's flow is highly erosive flow and can produce significant wear in the crossover tool even though the tool is typically made of 4140 steel or corrosion resistant alloys. The most severe damage occurs around the exit ports where the slurry exits the crossover tool and enters the inside of the production assembly. Typically, the crossover tool has inner and outer components that both have ports. As expected, any misalignment between such ports can aggravate wear as the slurry flows between them. If the wear is not managed properly, it can decrease the tool's tensile strength enough to cause failure under load and can also produce problems with sealing within the tool.

DETAILED DESCRIPTION

Figure 1:
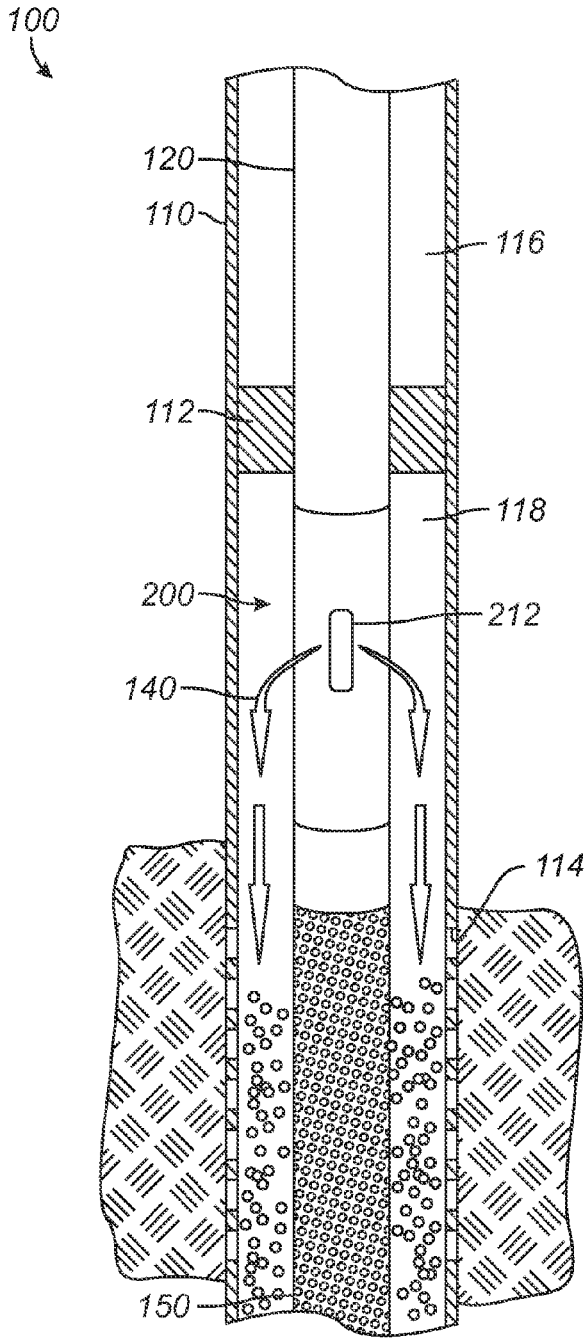
FIG. 1 illustrates a production assembly having a crossover tool.

A production assembly 100 illustrated in FIG. 1 has a production tubing string 120 run inside a well casing 110. At a desired depth, a packer 112 attached to the tubing string 120 seals an upper annulus 116 from a lower annulus 118. A crossover tool 200 and a screen assembly 150 suspend from the tubing string 120 in the lower annulus 118. To inject slurry in the lower annulus 118 for a gravel pack operation or the like, operators close off downhole communication from the tubing string 120 to the screen assembly 150 using a dropped ball, string manipulation, valve closure, or other technique known in the art. Uphole flow may or may not be dosed off depending on the stage of the operation. With the downhole flow into the screen assembly 150 closed, the operators pump the slurry down the tubing string 120. When it reaches the crossover tool 200, the slurry passes through one or more internal ports (not shown) on an internal component of the tool 200 and then exists out one or more external ports 212 on an external component of the crossover tool 200. Exiting these ports 212, the slurry 140 enters the lower annulus 118 so the gravel in the exiting slurry 140 can pack around the screen assembly 150. When the operation is completed, the packed gravel can filter production fluid from the formation flowing through perforations 114 in the casing 110.

As discussed previously, any misalignment in the crossover tool 200's internal ports (not shown) and external ports 212 can aggravate the wear produced by the flowing slurry. To overcome this, the crossover tool 200 is capable of aligning its internal and external ports 212 downhole using an internal sleeve that is rotatable inside an external sleeve.

Figure 2A:
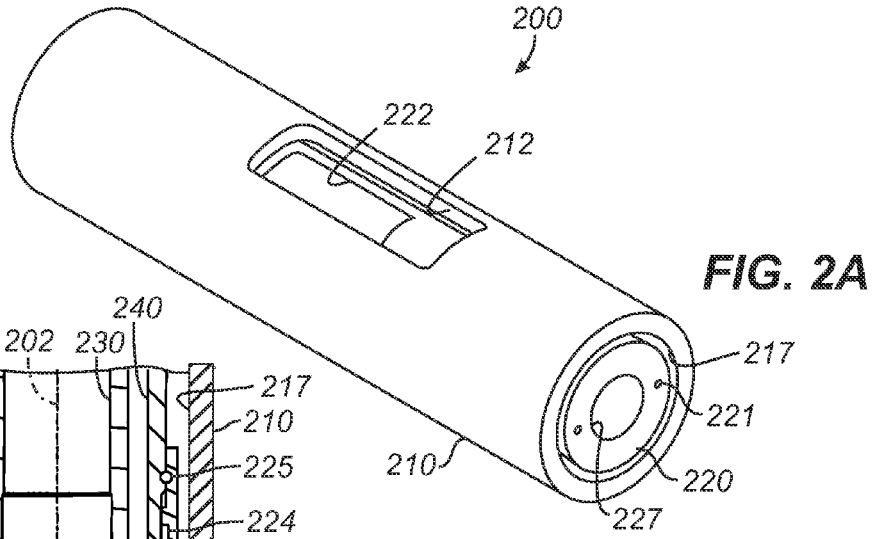
FIG. 2A is a perspective view of a crossover tool according to one embodiment of the present disclosure.
Figure 2B:
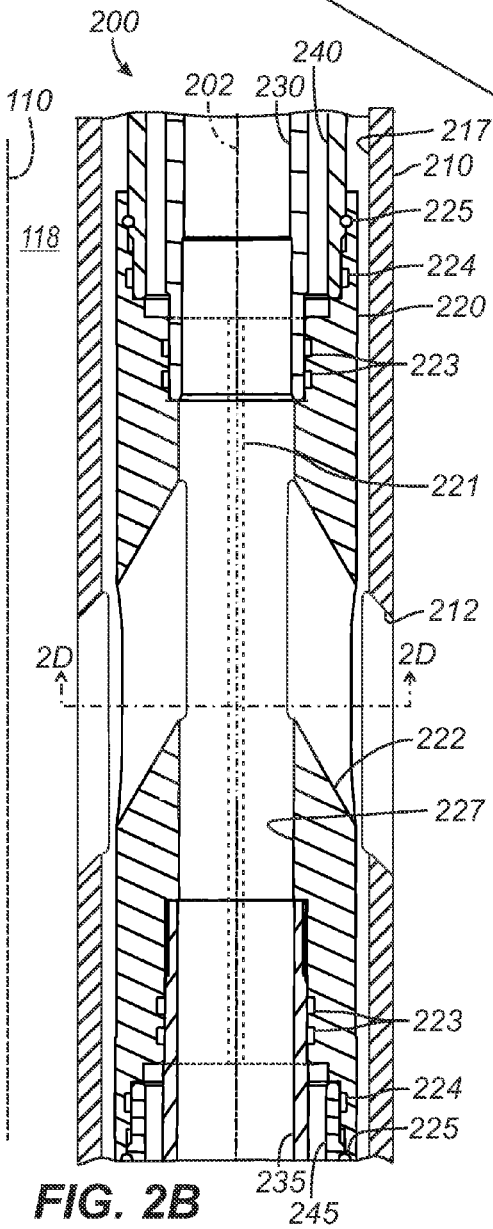
FIG. 2B illustrates the tool of FIG. 2A in cross-section coupled to tubing members.

As shown in FIGS. 2A-2D, a self-orienting crossover tool 200 includes an internal sleeve 220 rotatably positioned within an external sleeve 210. Both sleeves 210/220 define one or more external diversion ports 212/222 that are alignable with one another to divert slurry during operations as described above. In general, diversion ports 212/222 are substantially rectangular and extend perpendicularly through sleeves 210 and 220. Preferably, both diversion ports 212/222 are defined by slanted top and bottom ends so that they slope downwards from the interior bores 217/227 of sleeve 210/220, as shown in FIG. 2B. In addition, both sleeves 210/220 preferably have the same number of ports 212/222. However, external ports 212 may be larger and are preferably positioned lower in external sleeve 210 so as to make an overall slanted passage though both sleeves 210/220 when aligned.

As best shown in FIG. 2B, external sleeve 210 positions within casing 110 so that its diversion ports 212 communicate with the annulus 118 formed between sleeve 210 and casing 110. Being rotatably positioned within external sleeve 210, internal sleeve 220 has an upper end to which an upper internal tubing 230 couples with O-rings 223 and to which an upper intermediate tubing 240 also couples with a seal 224 and a bearing assembly 225. Likewise, internal sleeve 220 has a lower end to which a lower internal tubing 235 couples with O-rings 223 and to which a lower intermediate tubing 245 couples with a seal 224 and a bearing assembly 225. The upper and lower intermediate tubings 240 and 245 remain substantially fixed, while seals 224 and bearing assemblies 225 on the upper and lower ends allow internal sleeve 220 to rotate within external sleeve 210. (Reverse flow passages 221 may pass through the internal sleeve 220 to interconnect the annulus between upper tubings 230/240 with the annulus between lower tubings 235/245).

Figure 2C:
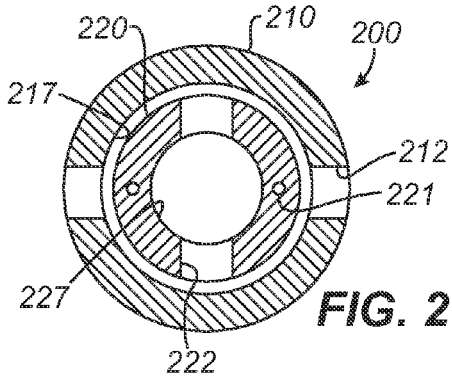
FIGS. 2C-2D are end-sections of the tool in FIG. 2A showing two alignment arrangements.

In use, crossover tool 200 is placed below a packer inside well casing. Once positioned downhole, diversion ports 212/222 may have a misaligned orientation (as shown in FIG. 2C) to increase the tools overall tensile strength while being manipulated downhole. In starting operations, operators pump slurry down the tubing. When the slurry meets the crossover tool 100, it is diverted through internal diversion ports 222, creating fluid friction in the annulus between sleeves 210/220 due to the misalignment of the ports 212/222. This fluid friction creates a thrust force that rotates internal sleeve 220 about its central axis 202 on its bearing assemblies 225.

Figure 2D:
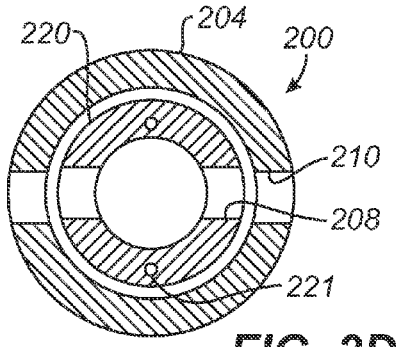

After rotating a sufficient degree, internal diversion ports 222 move into alignment with external diversion ports 212 (as shown in FIG. 2D) to produce a passage for the slurry to the annulus surrounding the tool 200. Diverted slurry flows through this resulting passage, delivering particulate to the desired location. Once ports 212/222 achieve alignment, corrective forces bias inner sleeve 220 to keep ports 212/222 aligned and to hinder any rotation by inner sleeve 220 away from alignment. In this way, ports 212/222 remain substantially aligned while pumped slurry passes through them to the surrounding annulus. This resulting alignment can, thereby, reduce wear to the components 210/220.

Figure 3A:
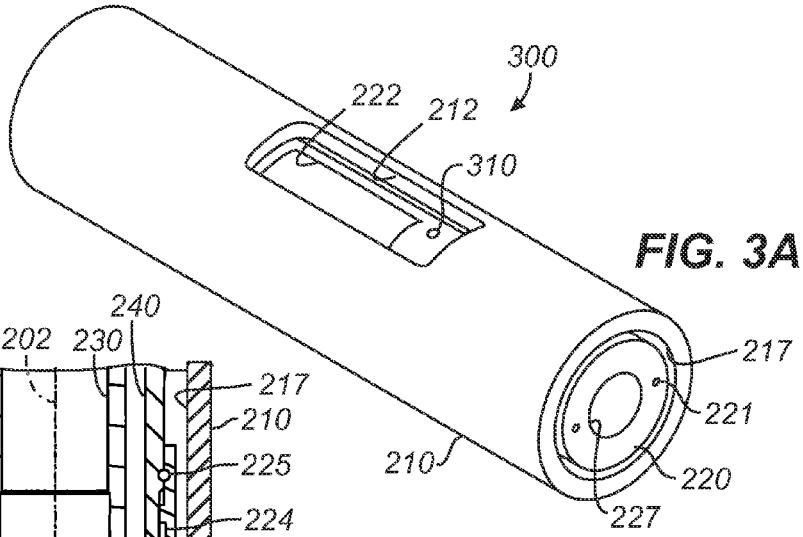
FIG. 3A is a perspective view of a crossover tool having an alignment port according to another embodiment of the present disclosure.
Figure 3B:
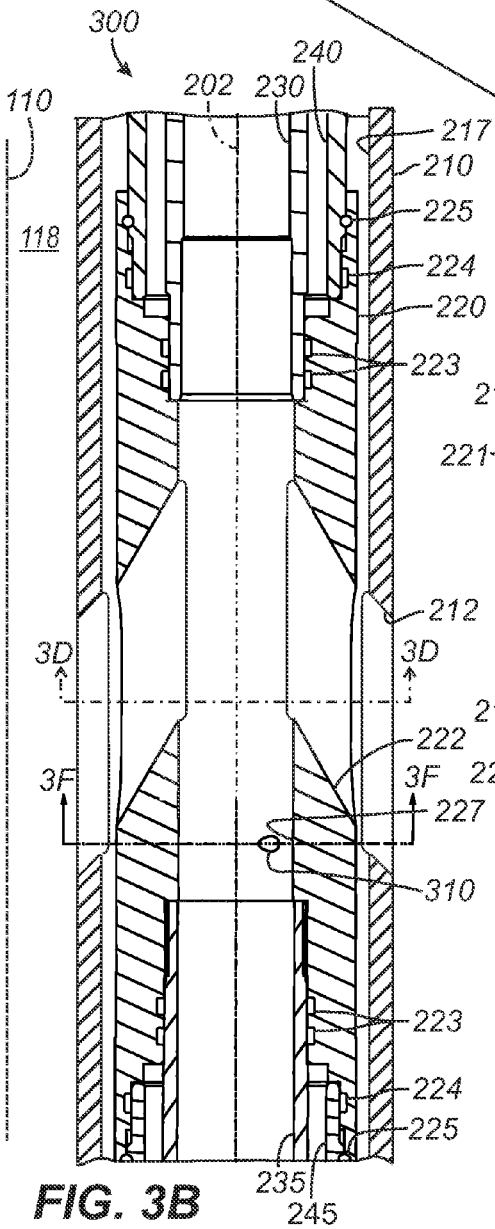
FIG. 3B illustrates the tool of FIG. 3A in cross-section coupled to tubing members.
Figure 3C:
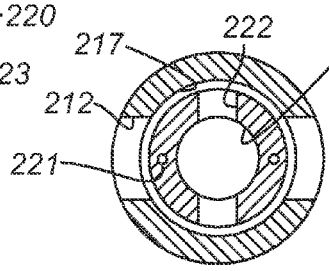
FIGS. 3C-3G are end-sections of the tool in FIG. 3A showing various arrangements of alignment.
Figure 3D:
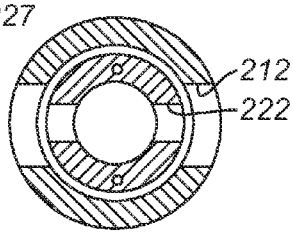
Figure 3E:
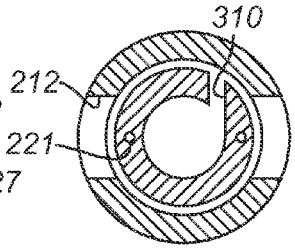
Figure 3F:
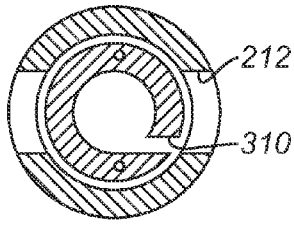
Figure 3G:
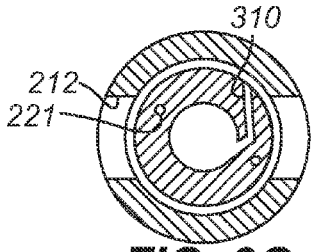

FIGS. 3A-3G illustrate another embodiment of a self-orienting crossover tool 300. Components of crossover tool 300 are substantially similar to those discussed in the embodiment of FIGS. 2A-2D so that like reference numbers are used for similar components. In the present embodiment, internal sleeve 220 defines a thrust or alignment port 310. This alignment port 310 communicates the interior of internal sleeve 220 with the inside of external sleeve 210. The alignment port 310 itself can have different configurations and can be straight, bent, or curved, as long as it is not coincident with the central rotational axis 202 of inner sleeve 220. In FIGS. 3E-3F, for example, alignment port 310 is substantially straight, whereas port 310 in FIG. 3G has a bent or angled configuration.

As before, diverted slurry pumped through crossover tool 300 causes internal sleeve 220 to rotate about is rotational axis 202 until its internal diversion ports 222 move into alignment with external diversion ports 212 (as shown in FIG. 3D), and corrective forces bias inner sleeve 220 to remain in this aligned orientation. In addition to the alignment caused by ports 212/222 themselves, the pumped slurry diverts through alignment port 310, which causes internal sleeve 220 to rotate rapidly until this port 310 substantially aligns with one of the diversion ports 212 (as shown in FIGS. 3E-3F).

In particular, flow through this port 310 tends to rotate internal sleeve 220 about its bearing assemblies 225 because alignment port 310 is eccentrically located (i.e., passing transversely and tangentially) to internal sleeve's rotational axis 202. Furthermore, a build-up of pressure when this port 310 is not aligned with one of the diversion ports 222 can help produce thrust to facilitate rotation of internal sleeve 210. As with ports 212/222, thrust from alignment port 310 may be less when it is aligned with diversion port 212, further discouraging any rotation by inner sleeve 220 away from alignment. In this way, alignment port 310 facilitates proper alignment of diversion ports 212/222 and can reduce wear to the components. (Although the alignment port 310 is shown toward the downhole end of the inner sleeve 220, it may be arranged at the uphole end as long as it can communicate with the external port 212 when aligned therewith).

FIGS. 4A-4D illustrate an embodiment of a self-orienting crossover tool 400, which again has similar components to previous embodiments so that like reference numbers are used for similar components. In addition to an alignment or thrust port 310 similar to that discussed previously, the crossover tool 400 has a temporary barrier 410. For its part, temporary barrier 410 is intended to increase flow through alignment port 310 and facilitate alignment between ports 212/222.

Figure 4A:
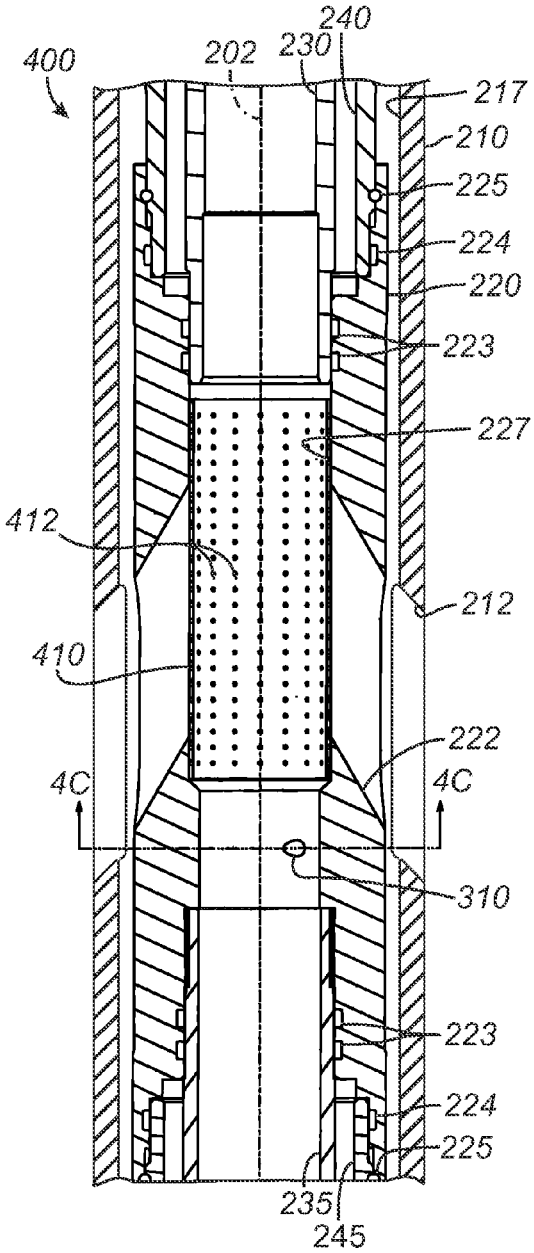
FIG. 4A is a cross-sectional view of a crossover tool having an alignment port and a disintegrating sleeve according to yet another embodiment of the present disclosure.
Figure 4B:
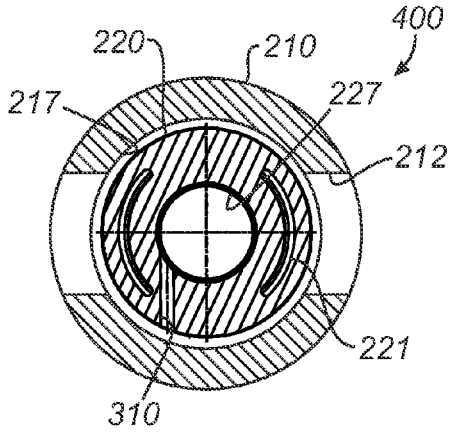
FIGS. 4B-4C are end-sections of the tool in FIG. 4A showing two alignment arrangements.
Figure 4C:
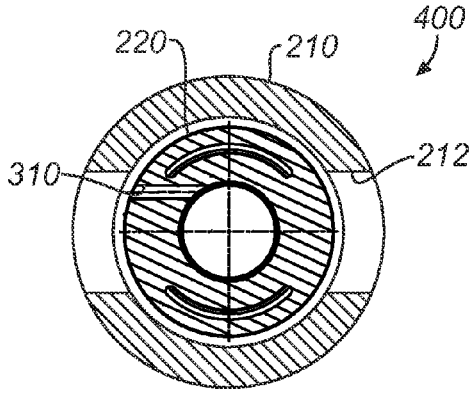
Figure 4D:
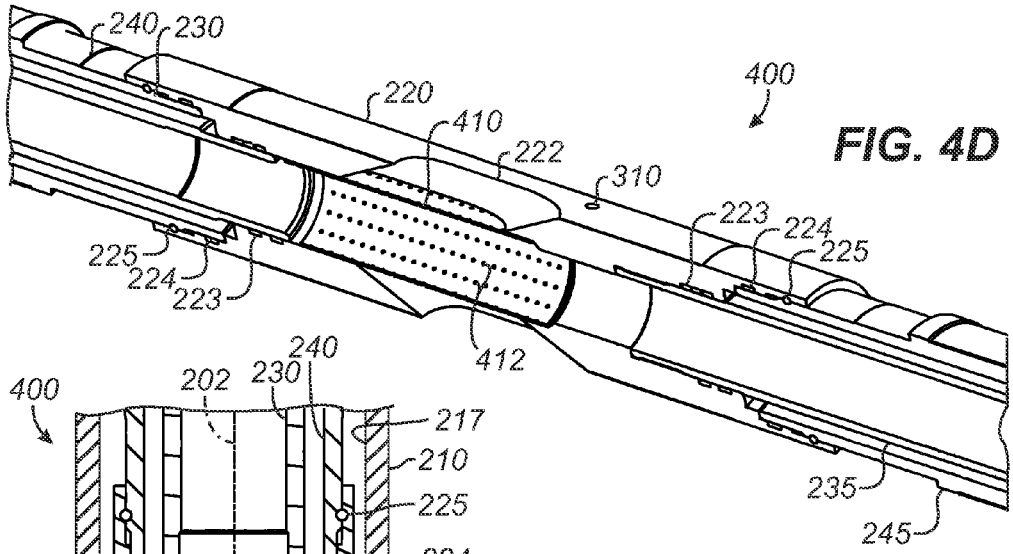
FIG. 4D is a perspective view of the tool in FIG. 4A without the external sleeve.

As shown in FIGS. 4A and 4D, temporary barrier 410 can be a cylindrically shaped sleeve positioned within the bore 227 of internal sleeve 220 and covering diversion ports 222. Temporary barrier 410 can be composed of a material intended to disintegrate in a wellbore environment, such as a water soluble, synthetic polymer composition including a polyvinyl, alcohol plasticizer, and mineral filler. Rather than a cylindrically shaped sleeve, temporary barrier 410 can take the form of a plug, plate, sheath, or other form capable of temporarily obstructing fluid flow through at least one of the diversion ports 212. Finally, temporary barrier 410 may be mechanically displaced, dissolved, fragmented, or eroded in various embodiments, and downhole triggering devices or agents may also be employed to initiate removal of barrier 410.

In use, temporary barrier 410 substantially blocks flow of fluid through diversion port 222, thereby increasing pressure in the internal passage and increasing thrust through alignment port 310. Preferably, temporary sleeve 410 is perforated as shown to allow at least some flow through the perforations 412. The increased thrust produced by alignment port 310 hastens rotation of internal sleeve 220 from an unaligned orientation (FIG. 4B) to an aligned orientation (FIG. 4C). Once alignment port 310 substantially aligns with diversion port 212 (FIG. 4C), the resulting thrust produced would be less than any thrust produced when sleeves 210/220 are not aligned. In this way, any further rotation of internal sleeve 210 would be discouraged. Eventually, wellbore fluid and/or downhole conditions cause temporary barrier 410 to disintegrate so fluid can then flow directly through ports 212/222.

Figure 4E:
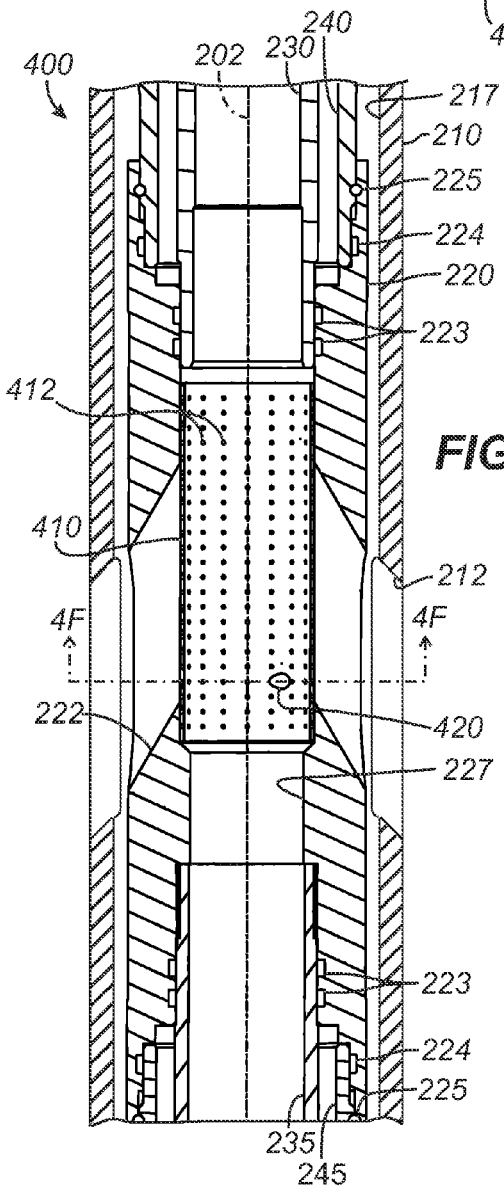
FIG. 4E is a cross-sectional view of the crossover tool in FIG. 4A having the alignment port defined in the disintegrating sleeve.
Figure 4F:
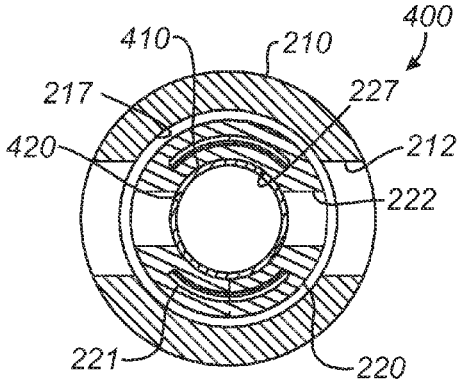
FIG. 4F is an end-section of the tool in FIG. 4E.

In an alternative shown in FIG. 4E, the temporary sleeve 410 can define an alignment or thrust port 420. This port 420 can be provided in addition to or as an alternative to any alignment port in internal sleeve 220 as in previous embodiments. Again, temporary barrier 410 substantially blocks flow of fluid through diversion port 222, thereby increasing pressure in the internal passage and the thrust or alignment port 420. Eventually, the thrust produced by alignment port 420 rotates internal sleeve 220 until alignment port 420 aligns with diversion port 212 as shown in FIG. 4F. The resulting thrust produced in this aligned condition would be less than any thrust produced when sleeves 210/220 have different orientations so any further rotation of internal sleeve 210 would be discouraged. Eventually, wellbore fluid and conditions cause temporary barrier 410 to disintegrate so fluid can then flow directly through ports 212, 222.

Figure 5A:
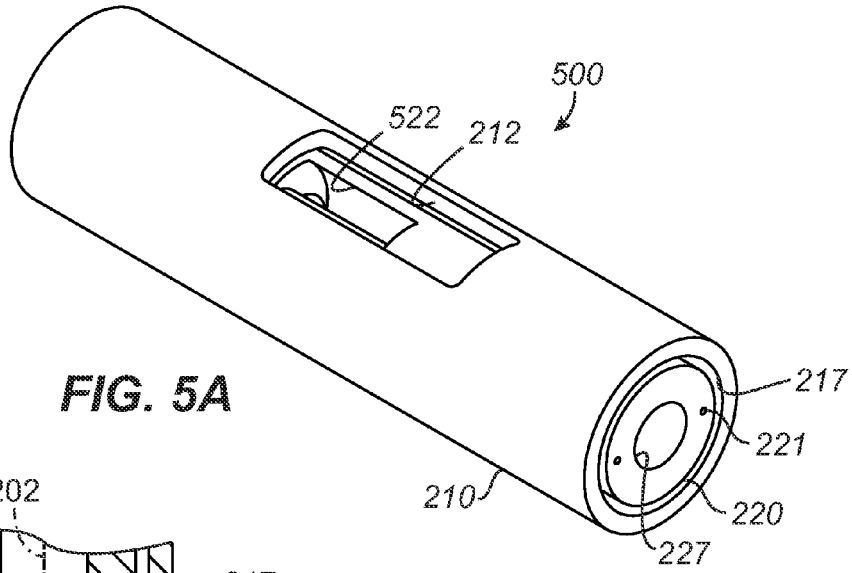
FIG. 5A is a perspective view of a crossover tool having diversion ports configured to align in accordance with another embodiment of the present disclosure.
Figure 5B:
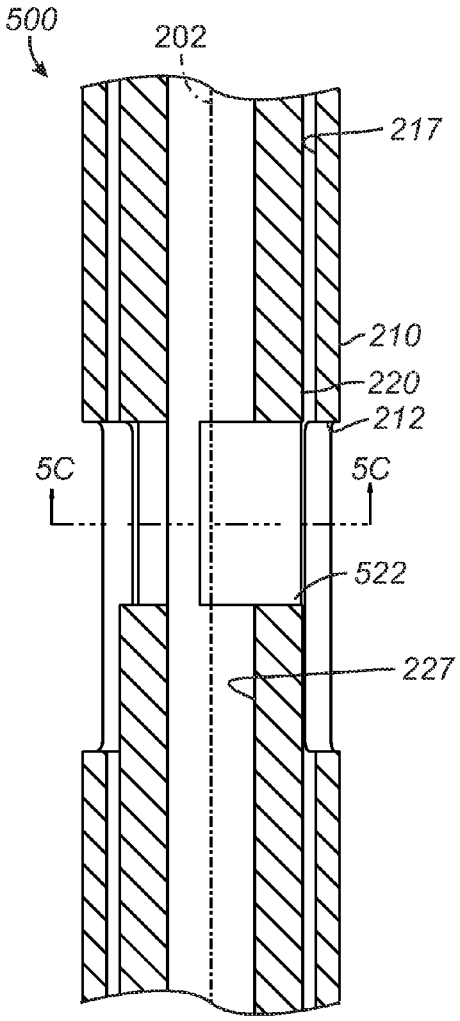
FIG. 5B shows a portion of the tool in FIG. 5A shown in cross-section.
Figure 5C:
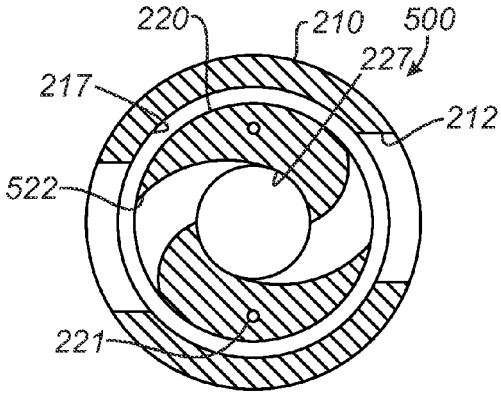
FIG. 5C is an end-section of the tool in FIG. 5A.

FIGS. 5A-5C illustrate an embodiment of a crossover tool 500 in which thrust for alignment is achieved by diversion ports 522 on the internal sleeve 220. Again, similar components between embodiments have the same reference numbers. Some elements in FIGS. 5A-5C, such as bearing assemblies, seals, tubing, and the like, are not shown for simplicity; however, the internal and external sleeves 210/220 of the tool 500 can be used with such components as disclosed in other embodiments. As best shown in the end-section of FIG. 5C, internal sleeve 220 defines diversion ports 522 that are slanted or tangentially oriented as opposed to the orthogonal ports of previous embodiments. As shown, these slanted diversion ports 522 can have curvilinear sidewalls so that the ports 522 present a spiral cross-section. However, the slanted diversion ports 522 may have straight sidewalls or other shapes as long as they define a tangential exit direction for fluid flow from the ports 522.

When diverted slurry flows through these diversion ports 522, it exits in a tangential direction, which causes internal sleeve 220 to rotate relative to external sleeve 210 until diversion ports 522 substantially align with external ports 212 as shown in FIG. 5C. In this aligned condition, corrective forces will substantially prevent the tendency of internal sleeve 220 to rotate out of alignment, because the thrust produced by diversion ports 522 when substantially aligned with diversion ports 212 would be less than thrust produced when the sleeves 210/220 are not aligned.

Figure 6A:
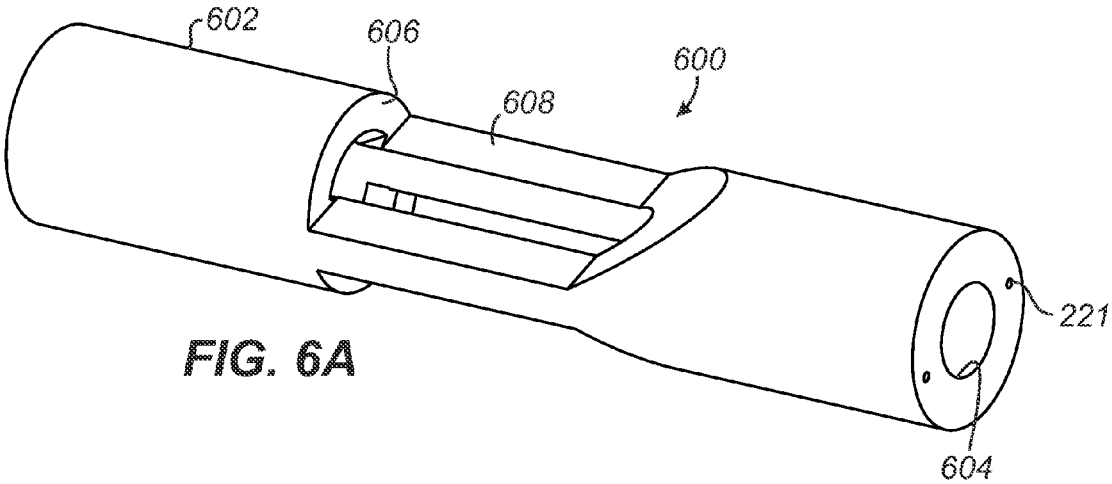
FIGS. 6A-6C illustrate a perspective view, a cross section, and an end section of another internal sleeve according to the present disclosure.
Figure 6B:
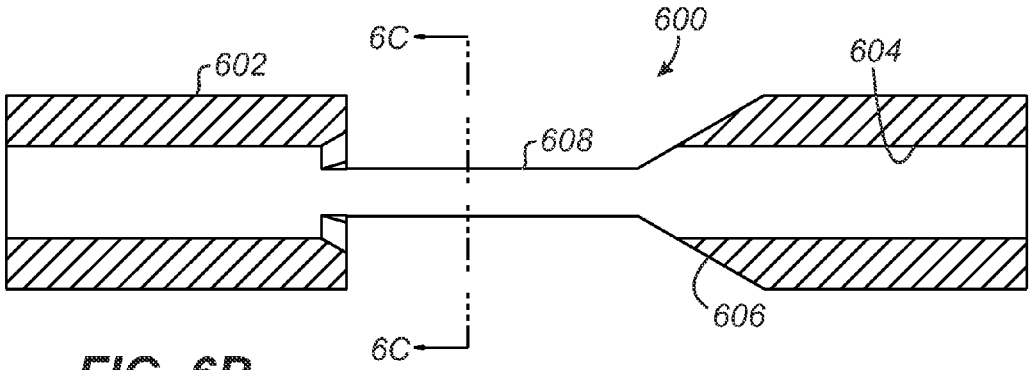
Figure 6C:
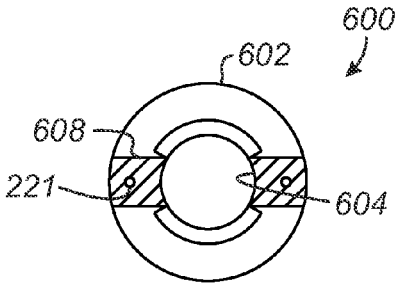

FIGS. 6A-6C illustrate a perspective view, a cross section, and an end section of another internal sleeve 600 according to the present disclosure. An external sleeve, bearing assemblies, seals, tubing, and the like are not shown for simplicity; however, the internal sleeve 600 can be used with such components as disclosed in other embodiments. For example, the internal sleeve 600 rotatably positions inside an external sleeve and uses bearings assemblies and seals for coupling to internal tubing as described previously.

In this embodiment, the sleeve 600 has a cylindrical body 602 defining an internal bore 604. Large side ports 606 are defined in the sides of the body 602 such that the body 602 forms two interconnecting stems 608 between upper and lower ends of the body 602. As shown, these ports 606 can have a square edge towards a first (upper end) of the body 602 and a slanted or angled edge towards a second (lower end) of the body 602. When positioned in an external sleeve (e.g., 210), fluid exiting from ports 606 can rotate sleeve 600 to align ports 606 with external ports (e.g., 212) on the surrounding external sleeve (210). Being large, these ports 606 may experience less wear as the pumped slurry passes through.

The foregoing description of preferred and other embodiments is not intended to limit or restrict the scope or applicability of the inventive concepts conceived of by the Applicants. In general, for example, components of the disclosed crossover tools may be fabricated from any suitable materials and according to any manufacturing techniques customary to oilfield production tools. In addition, features disclosed with reference to one embodiment may be combined with those disclosed with reference to other embodiments. For example, crossover tools disclosed herein discuss the use of alignment ports and modified diversion ports individually, but additional embodiments may combine these features together. In addition, the embodiments discussed herein use two diversion ports on each of the sleeves. However, other embodiments may use on diversion port on each sleeve, or any same or different number of diversion ports on the two sleeves.

As used herein, alignment between ports (such as port 212 with port 222, port 310 with port 222, etc.) refers to the relative orientation between the ports such that fluid can readily flow directly from one port through the other. The alignment may vary and may not need strict precision to achieve the purposes of the present disclosure.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole crossover tool for delivering fluid flow out an external sleeve disposed on external tubing in a wellbore, the external sleeve having a first axial bore and having an external port in a side of the external sleeve, the external port communicating the first axial bore outside the external sleeve, the crossover tool comprising:

internal tubing disposed in the external tubing and having first and second tubular members; and an internal sleeve rotatably disposed on the internal tubing with first and second bearing assemblies, the first and second bearing assemblies positioned respectively between first and second ends of the internal sleeve and the first and second tubular members, the internal sleeve having a second axial bore, the internal sleeve rotatably positioned within the first axial bore of the external sleeve and having an internal port in a side of the internal sleeve, the internal port communicating the second axial bore outside the internal sleeve and being alignable with the external port of the external sleeve, wherein the internal sleeve is adapted to rotate relative to the external sleeve in response to fluid flow communicated into the second axial bore at least until the internal port aligns with the external port.

2. The tool of claim 1, wherein the internal sleeve has a side port being alignable with the external port of the external sleeve, the side port being eccentrically located relative to a rotational axis of the internal sleeve.

3. The tool of claim 2, wherein in response to the fluid communicated into the second axial bore passing through the side port, the internal sleeve is adapted to rotate relative to the external sleeve at least until the side port aligns with the external port.

4. The tool of claim 2, wherein the internal sleeve comprises a barrier body positioned in the second axial bore and at least partially obstructing fluid flow through the internal port.

5. The tool of claim 4, wherein the barrier body comprises a material intended to disintegrate in the wellbore.

6. The tool of claim 4, wherein the barrier body comprises a cylindrical sleeve positioned within the second axial bore of the internal sleeve and at least partially covering the internal port.

7. The tool of claim 6, wherein the cylindrical sleeve has a plurality of perforations permitting restricted fluid flow therethrough.

8. The tool of claim 4, wherein the barrier body defines the side port being alignable with the external port on the external sleeve and being eccentrically located relative to the rotational axis of the internal sleeve.

9. The tool of claim 8, wherein in response to the fluid communicated into the second axial bore passing through the side port, the internal sleeve is adapted to rotate relative to the external sleeve at least until the side port aligns with the external port.

10. The tool of claim 1, wherein the internal port defines an exit direction substantially tangential to a rotational axis of the internal sleeve, and wherein in response to tangentially exiting fluid from the internal port, the internal sleeve is adapted to rotate relative to the external sleeve at least until the internal port aligns with the external port.

11. The tool of claim 1, wherein the internal sleeve defines a flow passage extending therethrough from the first end to the second end, the flow passage being separate from the second axial bore and permitting fluid flow between the first and second ends of the internal sleeve.

12. The tool of claim 1, wherein the internal sleeve defines at least one fluid passage being separate from the second axial bore and extending from the first end of the internal sleeve to the second end of the internal sleeve.

13. The tool of claim 12, wherein the first tubular member comprises a first internal member disposed inside a first external member, and wherein the second tubular member comprises a second internal member disposed inside a second external member, the first and second internal members communicating with the second axial bore of the internal sleeve, the first and second external members communicating with the at least one fluid passage of the internal sleeve.

14. A downhole crossover tool for delivering fluid flow out an external sleeve disposed on external tubing in a wellbore, the external sleeve having a first axial bore and having an external port communicating with the first axial bore, the crossover tool comprising:

internal tubing disposed in the external tubing and having first and second tubular members; and an internal sleeve rotatably disposed on the internal tubing with first and second bearing assemblies, the first and second bearing assemblies positioned respectively between first and second ends of the internal sleeve and the first and second tubular members, the internal sleeve having a second axial bore, the internal sleeve rotatably positioned within the first axial bore of the external sleeve, the internal sleeve having an internal port communicating with the second axial bore and being alignable with the external port, the internal sleeve having a side port communicating with the second axial bore and being alignable with the external port, wherein the internal sleeve is adapted to rotate relative to the external sleeve in response to fluid flow communicated into the second axial bore and through the side port at least until the side port aligns with the external port.

15. The tool of claim 14, wherein the side port is eccentrically located relative to a rotational axis of the internal sleeve.

16. The tool of claim 14, wherein the internal sleeve comprises a barrier body positioned in the second axial bore and at least partially obstructing fluid flow through the internal port.

17. The tool of claim 16, wherein the barrier body comprises a material intended to disintegrate in the wellbore.

18. The tool of claim 16, wherein the barrier body comprises a cylindrical sleeve positioned within the second axial bore of the internal sleeve and at least partially covering the internal port.

19. The tool of claim 18, wherein the cylindrical sleeve has a plurality of perforations permitting restricted fluid flow therethrough.

20. The tool of claim 16, wherein the barrier body of the internal sleeve has the side port.

21. The tool of claim 16, wherein the internal sleeve comprises a main body having the second axial bore in which the barrier body positions, wherein the main body of the internal sleeve has the side port.

22. The tool of claim 14, wherein the internal sleeve defines a flow passage extending therethrough from the first end to the second end, the flow passage being separate from the second axial bore and permitting fluid flow between the first and second ends of the internal sleeve.

23. A downhole crossover tool for delivering fluid flow out an external sleeve disposed on external tubing in a wellbore, the external sleeve having a first axial bore and having an external port in a side of the external sleeve, the external port communicating the first axial bore outside the external sleeve, the crossover tool comprising:

internal tubing disposed in the external tubing and having first and second tubular members; and internal means disposed on the internal tubing and positioned in the first axial bore of the external sleeve for communicating fluid flow from a second axial bore to the first axial bore through an internal port in a side of the internal means;

means disposed respectively between first and second ends of the internal means and the first and second tubular members of the internal tubing for rotatably supporting the internal means within the first axial bore of the external sleeve; and means for rotating the internal means relative to the external sleeve at least until the internal port aligns with the external port.

24. The tool of claim 23, wherein the means for rotating the internal means relative to the external sleeve comprises:

fluid communicating means for communicating fluid flow eccentrically from the second axial bore to the first axial bore, the fluid communicating means being alignable with the external port of the external means.

25. The tool of claim 24, further comprising means for at least partially obstructing fluid flow through the internal port.

26. The tool of claim 25, wherein the means for at least partially obstructing fluid comprises means for disintegrating within the wellbore.

27. The tool of claim 25, wherein the means for at least partially obstructing fluid flow through the internal port comprises the fluid communicating means for communicating fluid flow eccentrically from the second axial bore to the first axial bore.

28. The tool of claim 25, wherein the internal means comprises means for communicating fluid flow separate from the first axial bore from one end of the internal means to an opposite end of the internal means.

29. The tool of claim 23, wherein the means for rotating the internal means relative to the external sleeve comprises means for producing tangentially exiting fluid flow from the internal port of the internal means.

30. A downhole crossover tool for delivering fluid flow out an external sleeve disposed on external tubing in a wellbore, the external sleeve having a first axial bore and having an external port communicating with the first axial bore, the crossover tool comprising:

internal tubing disposed in the external tubing and having first and second tubular members; and an internal sleeve having a main body and a barrier body, the main body rotatably disposed on the internal tubing with first and second bearing assemblies, the first and second bearing assemblies positioned respectively between first and second ends of the main body and the first and second tubular members, the main body having a second axial bore and rotatably positioned within the first axial bore of the external sleeve, the main body having an internal port communicating with the second axial bore and being alignable with the external port, the barrier body positioned in the second axial bore of the main body and at least partially obstructing fluid flow through the internal port, the internal sleeve having a side port communicating with the second axial bore and being alignable with the external port, wherein the internal sleeve is adapted to rotate relative to the external sleeve in response to fluid flow communicated into the second axial bore and through the side port at least until the side port aligns with the external port.

31. The tool of claim 30, wherein the side port is eccentrically located relative to a rotational axis of the internal sleeve.

32. The tool of claim 30, wherein the barrier body comprises a material intended to disintegrate in the wellbore.

33. The tool of claim 30, wherein the barrier body comprises a cylindrical sleeve positioned within the second axial bore of the main body and at least partially covering the internal port.

34. The tool of claim 30, wherein the barrier body has a plurality of perforations permitting restricted fluid flow therethrough.

35. The tool of claim 30, wherein the internal tubing comprises first and second tubular members, and wherein the first and second bearing assemblies are positioned respectively between the first and second ends of the main body and the first and second tubular members.

36. The tool of claim 30, wherein the barrier body of the internal sleeve has the side port.

37. The tool of claim 30, wherein the main body of the internal sleeve has the side port.

38. The tool of claim 30, wherein the main body defines a flow passage extending therethrough from the first end to the second end, the flow passage being separate from the second axial bore and permitting fluid flow between the first and second ends of the internal sleeve.

* * * * *